United States Patent [19]

Webb

[11] 4,280,476

[45] Jul. 28, 1981

[54] STOVE HAVING AUXILIARY DAMPER OPERABLY CONNECTED TO ACCESS DOOR

[76] Inventor: James E. Webb, Rte. #1, Box 460, Wingate, N.C. 28174

[21] Appl. No.: 108,560

[22] Filed: Dec. 31, 1979

[51] Int. Cl.[3] ..... F23L 3/00

[52] U.S. Cl. ..... 126/286; 126/287; 126/66

[58] Field of Search ..... 126/77, 83, 75, 60, 126/61, 66, 63, 286, 287, 285 R, 289, 290, 292, 293; 110/158, 175; 236/10

[56] References Cited

U.S. PATENT DOCUMENTS

| | | | |
|---|---|---|---|
| 204,406 | 5/1878 | White | 126/287 |
| 1,066,962 | 7/1913 | Walker et al. | 126/287 |
| 1,965,179 | 7/1934 | Freeland | 126/287 |
| 2,352,057 | 6/1944 | Wingert | 126/287 |
| 2,443,910 | 6/1948 | Higley | 126/83 |
| 2,444,402 | 6/1948 | Klein | 126/287 |
| 4,030,479 | 6/1977 | Webb | 126/287 |
| 4,192,285 | 3/1980 | Nietupski | 126/60 |
| 4,207,860 | 6/1980 | Schrock | 126/60 |

*Primary Examiner*—James C. Yeung
*Attorney, Agent, or Firm*—Bell, Seltzer, Park & Gibson

[57] ABSTRACT

A stove of the wood burning type is provided with a smoke passage having a main opening adjacent the access door of the stove and an auxiliary opening therein which is located further away from the access door and more closely adjacent the rear portion of the smoke passage and the chimney than the main opening. A regulator damper controls the rate of flow of products of combustion from the combustion chamber through the main opening and the smoke passage to the chimney, and an auxiliary damper normally closes the auxiliary opening when the access door is in a normally closed position. Apparatus is operably associated with the auxiliary damper and the stove access door for effecting movement of the auxiliary damper from the normally closed position to the opened position prior to the access door being opened for redirecting the products of combustion through the auxiliary opening and thus further away from the access door so as to thereby prevent the escapement of smoke through the stove access opening when the access door is opened.

14 Claims, 6 Drawing Figures

STOVE HAVING AUXILIARY DAMPER OPERABLY CONNECTED TO ACCESS DOOR

FIELD OF THE INVENTION

This invention relates to solid fuel burning, space heating stoves, commonly known as wood burning stoves, and more especially to a stove equipped with an improved damper means arranged to avoid smoke entering a room when an access door is opened, such as for inserting wood or other solid fuel in the firebox or combustion chamber of the stove.

BACKGROUND OF THE INVENTION

While so-called wood burning stoves have existed for many years, for some time such stoves were considered somewhat outmoded by the use of more efficient liquid and/or gas fired heaters and heating systems. As is well known, however, wood burning stoves, especially those suited for installation in existing fireplaces, have become quite popular because of the recent scarcity of and increases in the cost of liquid and gaseous fuels as compared to solid fuels, such as wood and coal. Thus, many homes now use wood burning stoves as a sole medium for heating the home or to augment other types of heating equipment in the home.

Although considerable progress has been made in the efficiency and operation of wood burning stoves over the past few years, to my knowledge, most wood burning stoves have presented a substantial problem of smoke escaping from the combustion chamber or firebox into the room when the access door of the stove was opened. This problem has been further aggravated in the case of stoves of the type whose fireboxes are virtually airtight, with the exception of a controlled draft and a normally minimal exhaust or discharge of the products of combustion or smoke outwardly through the chimney so as to obtain highly efficient burning of and maximum heat from the fuel in the combustion chamber.

It is known to provide stoves with a damper operable connected to the access door of the stove so as to be opened when the door of the stove is opened. Stoves of this type are disclosed in U.S. Pat. Nos. 204,406, 1,066,962 and 2,444,402. However, since the access door of a stove of this type is relied upon to concurrently move the damper to an opened position as the access door is being opened, it has been determined that in some instances smoke can escape through the access door opening while the damper is being opened, thus defeating, to some extent, the intended purpose of the opening of the damper.

SUMMARY OF THE INVENTION

It is therefore an object of this invention to provide a stove of the general character described which has a regulator damper means for controlling the rate of flow of products of combustion from a combustion chamber through a main opening to a chimney, with the main opening being located adjacent the access door of the stove, and also wherein an auxiliary damper means is provided which normally closes an auxiliary opening when the stove access door is closed, the auxiliary opening being located substantially further away from the stove access door and more closely adjacent the rear portion of the stove than the main opening so that, upon movement of the auxiliary damper means to an opened position, which is effected prior to the access door being opened, the smoke is redirected through the auxiliary opening and thus further away from the access door so as to prevent the escapement of smoke through the access opening when the access door is opened.

According to the invention, a stove of the character described is provided having means defining an elongate smoke passage which extends rearwardly from adjacent the front of the stove and along an upper portion of the stove above the zone for burning combustibles in the combustion chamber thereof, with a rear portion of the smoke passage being adapted to communicate with a chimney for exhausting the products of combustion from the combustion chamber. The smoke passage has a main opening and an auxiliary opening therein for communication with the interior of the combustion chamber and a regulator damper means is associated with the smoke passage for normally adjustably restricting the flow of the products of combustion from the combustion chamber through the main opening and the smoke passage to the chimney. The main opening is located within the combustion chamber and adjacent the front of the stove so that the heated air and products of combustion normally flow in a generally sinuous path toward the access door and then upwardly and away from the access door and into the main opening. Auxiliary damper means normally closes the auxiliary opening, with the auxiliary opening being located substantially further away from the access door than the main opening and positioned closely adjacent the rear portion of the smoke passage communicating with the chimney, and means are operably associated with the auxiliary damper means and the stove access door for effecting movement of the auxiliary damper means from the normally closed position to the opened position prior to the access door being opened, for redirecting the products of combustion through the auxiliary opening and thus further away from the access door so as to thereby prevent the escapement of smoke through the access door opening when the access door is opened.

BRIEF DESCRIPTION OF THE DRAWINGS

Some of the objects and advantages of the invention having been stated, others will appear as the description proceeds when taken in connection with the accompanying drawings, in which.

DETAILED DESCRIPTION

Figure 1:
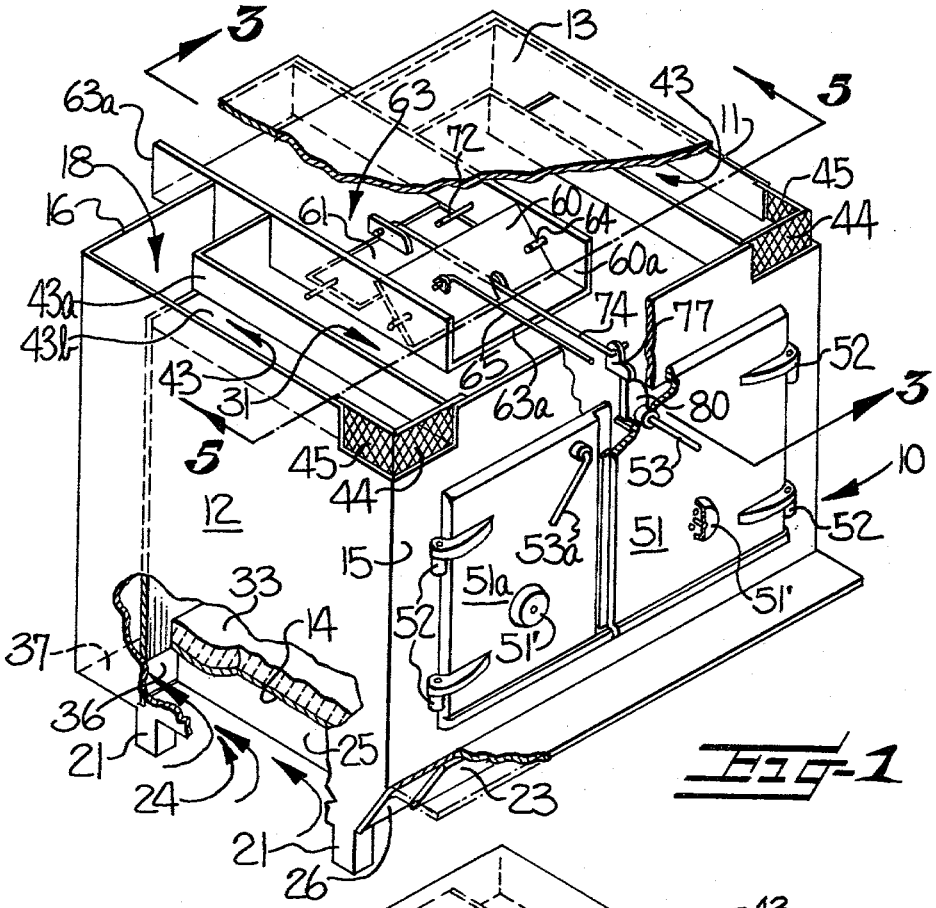
FIG. 1 is a perspective view looking down at the top, front and left side of a stove embodying the present invention, with portions broken away.

Referring more specifically to the drawings, the stove embodying the present invention generally comprises a housing broadly designated at 10 which is of generally rectangular box-like form and includes opposite side walls 11, 12, a top wall 13, a bottom wall 14, a front wall 15, and a double rear wall comprising an outer rear wall 16 and an inner rear wall 17. The inner rear wall 17 is spaced forwardly from the outer rear wall 16 so that the walls 16, 17 define therebetween an enclosed generally vertically extending air heating chamber generally designated at 18.

The front and rear portions of the side walls 11, 12 are provided with suitable legs 21 thereon for supporting the stove housing 10 in spaced relation above the floor. The lower edges of side walls 11, 12 and the outer and inner rear walls 16, 17 preferably terminate on about the same horizontal plane and also preferably extend sufficiently below the level of bottom wall 14 to provide space between the lower portions of the opposite side walls 11, 12 and beneath the bottom wall 14 to accommodate an ashtray 23 and a pair of open-bottomed airflow inlet channels or passages 24 (FIGS. 1 and 5) beneath bottom wall 14. The airflow inlet channels 24 are defined between the lower portions of the opposite side walls 11, 12 and respective substantially vertical partitions 25 spaced a substantial distance apart from each other and extending substantially parallel to the opposite side walls 11, 12.

The rear and top edges of the partitions 25 may be welded or otherwise suitably secured to the inner rear wall 17 and the bottom wall 14, with the front ends of the channels 24 being closed by suitable downwardly and rearwardly inclined closure members 26. The inclined closure members 26 may be suitably secured to the front lower portions of the respective side walls 11, 12 and the partitions 25, and preferably, the upper edges of the closure members 26 are disposed on about the same vertical plane as the front wall 15 of housing 10.

The ashtray 23 is generally in the form of a drawer and has outwardly projecting portions 27 on the opposite side walls thereof which are adapted to slide on suitable slide members 28 (FIG. 5) carried by and suitably secured to the proximal surfaces of the partitions 25. The front inclined closure members 26 define an opening therebetween to accommodate the ashtray 23 for inserting and removing the same from beneath the bottom wall 14 and the lower edge of front wall 15 of housing 10.

The housing side, top, bottom, front, and inner rear walls 11–15 and 17 define a combustion chamber or firebox generally designated at 31 for burning combustibles, i.e., solid fuel, such as wood, coal, and the like therein. Such fuel is placed in a lower rear zone of the combustion chamber 31 and is supported during the burning thereof on a suitable floor 33 of refractory material (FIGS. 3 and 5) covering the bottom wall 14 of housing 10.

The refractory material floor 33 may be a form of grate. To this end, the refractory material floor 33 may be about one inch (2.54 cm) thick and may be provided with a plurality of holes 34 therethrough of generally frusto-conical shape aligned with corresponding holes 35 through the bottom wall 14 for passage of ashes from the combustion chamber 31 into the ashtray 23. In practice, the holes 34 were about ½ inch (1.27 cm) diameter at their upper ends and about ¾ inch (1.91 cm) diameter at their lower ends, with the holes 35 in the bottom wall 14 being about ¾ inch (1.91 cm) diameter, for example.

As heretofore indicated, the rear walls 16, 17 defining heating chamber 18 extend downwardly below the housing bottom wall 14. This is desirable, not only for accommodating the ashtray or drawer 23, but to also accommodate forwardly forcing cold air inlet openings 26 (FIGS. 1 and 5) formed in the opposite lower corner portions of the housing inner rear wall 17, and which openings 36 are aligned with the respective airflow channels 24. Also, the bottom of the air heating chamber 18 is closed by a plate member 37. Thus, suitable fan means 40, positioned in the lower opposite corner portions of the air heating chamber 18, will normally induce relatively cool air to flow inwardly beneath the outside walls of the stove and upwardly into the air inlet passages 24 at the lower opposite sides of the stove and then into the lower corners of the air heating chamber 18.

Since the inner rear wall 17 of housing 10 serves as the front wall of heating chamber 18 and as the rear wall of combustion chamber 31, it is apparent that the combustion chamber 31 is in direct heat exchanging relation to the air heating chamber 18 so as to heat the air being circulated upwardly therethrough by the fan means 40. It is preferred, however, that the air heating chamber 18 is provided with a plurality of baffles 42 therein (FIGS. 2 and 5), which may be arranged somewhat in the manner illustrated, so as to circulate the air through the air heating chamber 18 in somewhat sinuous patterns as it is discharged from the outlets of the respective fan means 40.

Figure 2:
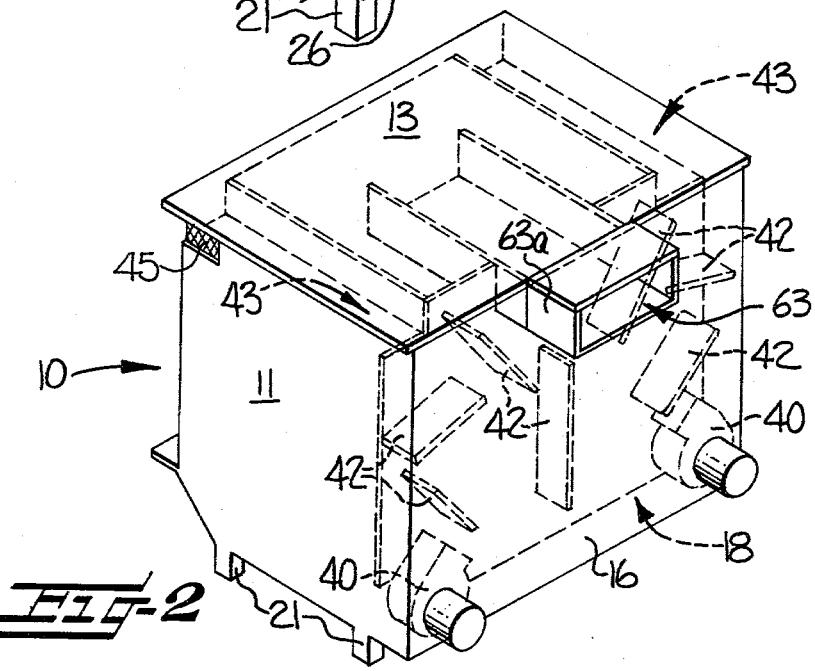
FIG. 2 is a perspective view looking down at the top, rear and right-hand side of the stove shown in FIG. 1.
Figure 5:
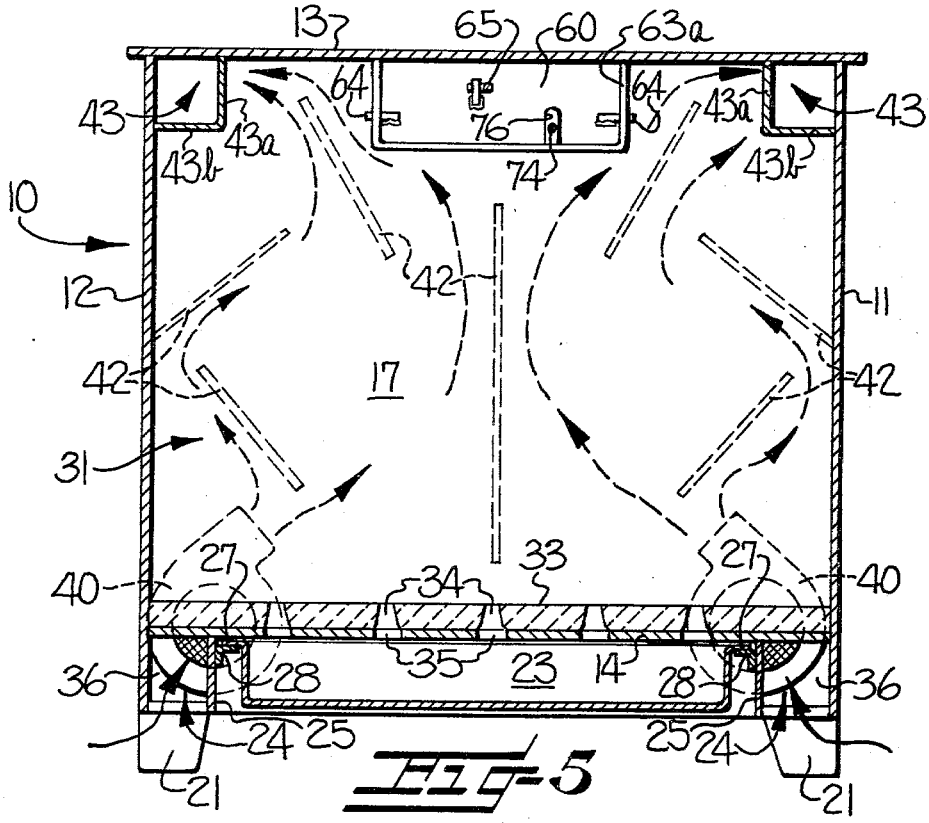
FIG. 5 is a transverse vertical sectional view taken substantially along line 5—5 in FIG. 1.

Since the stove is devised so that the rear portion thereof may be positioned in an existing fireplace or next to a room wall, it is preferred that air heated in the heating chamber 18 is exhausted from the front portion of the stove and into the room. Therefore, as best shown in FIGS. 1, 2 and 5, a pair of generally horizontal outlet airflow channels 43 are provided which extend forwardly from the upper corners of the heating chamber 18 and along the junctures of the top wall 13 with the respective opposite side walls 11, 12, and the front wall has a pair of air outlet openings 44 located in opposite upper corner portions thereof for exhausting heated air from the heating chamber 18 through the airflow channels 43 and the air outlet openings 44. The horizontal outlet airflow channels 43 may be formed by means of respective vertical and horizontal wall members **43*a*, 43*b* cooperating with the top wall 13 and the opposite side walls 11, 12, as best shown in FIG. 5. Thus, the outlet airflow channels 43 are in direct heat exchanging relation to the combustion chamber 31. It is apparent that the upper corners of the rear inner wall 17 are provided with suitable openings therethrough for effecting communication between the upper corners of the air heating chamber 18 and the respective outlet airflow channels 43, as best shown in FIGS. 1 and 2**.

It will also be observed in FIGS. 1 and 2 that the opposite side walls 11, 12 are provided with respective air outlet openings 45 in the upper forward corner portions thereof and communicating with the respective airflow channels 43, to aid in directing heated air sideways as well as forwardly from the stove. The openings 44 and 45 at each side of the stove may be coextensive and may be covered with suitable grids as shown in FIG. 1.

The stove is provided with a relatively large access opening 50 (FIGS. 3–6) in the front wall 15 for inserting combustibles therethrough into the combustion chamber 31, and at least one access door normally closes the access opening 50 while the stove is in use. In this instance, the access opening 50 is closed by a pair of hinged access doors 51, 51*a* whose distal side portions are hingedly mounted on front wall 15, as at 52 (FIG. 1). Each access door may be provided with a suitable manually adjustable air inlet damper 51' for manually controlling the admission of air into the combustion chamber 31 as needed to aid in combustion of the fuel therein. Since each air inlet damper 51' may be of well-known construction, a detailed illustration and description thereof is deemed unnecessary. By way of example, each air inlet damper 51' may take the form of a hollow cap member covering holes through the respective door and having a central threaded stem thereon threaded into the respective access door 51, 51*a*.

The doors 51, 51*a* are provided with suitable handle means, embodied in respective handles 53, 53*a*, for manually opening and closing the doors. As preferred, access door 51*a* is held in the normally closed position by normally active latch means associated with the access door 51 and by the inner or free edge portion of the access door 51 overlapping the access door 51*a* when they are in the normally closed position. Since the latch means associated with the access door 51 is concerned with an improved damper arrangement of the present invention, the latch means will be later described.

According to the invention, the improved damper arrangement generally comprises a main or regulator damper means 60 and an auxiliary damper means 61 (FIGS. 1, 3 and 6) cooperating with respective main and auxiliary openings 60*a*, 61*a* in a smoke passage 63. The main opening 60*a* is located adjacent access opening 50, and the auxiliary opening 61*a* is normally closed so that heated air and smoke or products of combustion normally flow forwardly in a generally sinuous path from a lower zone of the combustion chamber 31 toward the front wall 15 and the access doors 51, 51*a* of the stove and then upwardly and rearwardly through the main opening 60*a* and the smoke passage 63 to the usual chimney, not shown. Such sinuous path of the heated air is desirable so as to cause the heated air to heat the front portion and top wall of the stove and thereby radiate the heat outwardly therefrom into the room area most desired to be heated thereby.

On the other hand, it is desirable to avoid directing the smoke forwardly in the combustion chamber 31 when the access doors 51, 51*a* are opened so as to prevent escapement of smoke through the stove access opening 50. Therefore, the normally closed auxiliary opening 61*a* is located rearwardly of the regulator damper means 60, that is, the auxiliary opening 61*a* is located further away from the access doors 51, 51*a* and more closely adjacent the rear portion of the smoke passage 63 and the chimney than the main opening 60*a*, and means are operably associated with the auxiliary damper means 61 and at least the access door 51 for effecting movement of the auxiliary damper means 61 from the normally closed position of FIGS. 1, 3 and 4 to the opened position of FIG. 6 prior to the access door 51 being opened for thereby redirecting the products of combustion or smoke through the auxiliary opening 61*a* and thus further away from the access opening 50. Since the door 51*a* is normally maintained in a closed position by the overlapping door 51, it follows that the access door 51, which is normally closed and is normally maintained in a closed position by latch means to be later described, must be released and at least partially opened in order to release the other access door 51*a* and permit the same to be opened.

In the illustrated embodiment of the damper arrangement, the smoke passage 63 is defined by an elongate substantially rectangular duct 63*a* which extends forwardly and rearwardly within the upper medial or central portion of combustion chamber 31 and whose open rear end portion extends outwardly through the rear walls 16, 17 and is adapted to communicate with a chimney. Since the rear portion of the stove may be positioned within a fireplace, it is apparent that the rear open end portion of the duct 63*a* may be positioned within the fireplace or the like for effecting communication thereof with the chimney. The top wall 14 of housing 10 also serves as the top wall for the smoke passage defining duct 63*a*, and the bottom and opposed side walls of the duct 63*a* are collectively generally in the form of a channel whose front end portion is spaced rearwardly from the front wall 15 for defining the main opening 60*a* adjacent the front upper portion of the combustion chamber 31.

Since the auxiliary damper means 61 is normally closed and the regulator or main damper means 60 is normally opened to a predetermined extent for normally permitting the products of combustion or smoke to be exhausted from the combustion chamber 31 through the smoke passage 63 to the chimney, it can be appreciated that the air heated in the combustion chamber 31 flows in a generally forward and upward path toward the front wall 15 and the access doors 51, 51*a* in heat exchanging relation thereto, whereupon the heated air flows rearwardly into the main opening 60*a* and through the smoke passage 63 in its course to the chimney. Accordingly, it is to be noted that, in addition to the housing top wall 13 and the outlet airflow channels 43 being heated by the heat being generated in the combustion chamber 31 being in direct heat exchanging relation with the housing top wall 13 and the airflow channels 43, the heated air flowing through the smoke passage 63 further heats the housing top wall 13 by flowing in direct heat exchanging relation to the medial portion of the top wall 13. The effect of the air flowing in the smoke passage 63 for heating the top wall 13 also is enhanced by the smoke passage defining duct 63*a* being in direct heat exchanging relation to the combustion chamber 31.

The regulator damper means 60 is shown in the form of a substantially rectangular plate normally inclined upwardly and rearwardly at an angle and extending across the smoke passage 63 so as to regulate or restrict the flow of air and products of combustion from the combustion chamber 31 through the main opening 60*a* and the smoke passage 63 to the chimney. The regulator damper means 60 is pivotally mounted, as at 64, on opposed side wall portions of the duct 63*a*, with the pivotal axis 64 of the regulator damper means 60 being located forwardly of and below the mean center of gravity of the regulator damper means 60 so that the regulator damper means 60 is biased toward the open position by gravity.

In order to adjust the regulator damper means 60 relative to the smoke passage 63, the front or inner end of a link means or rod 65 is pivotally connected to the medial portion of the regulator damper means 60, as at 66, above and rearwardly of the pivotal axis 64 of the regulator damper means 60. The rod 65 extends forwardly, loosely penetrates the front wall 15 of housing 10, and loosely extends through a guide tube 67 welded or otherwise suitably secured to and projecting forwardly from the front wall 15. Manually operable control means is positioned exteriorly of the stove and is operably connected to the regulator damper means 60 for adjusting the same relative to the smoke passage 63. Such manually operable control means is illustrated as an internally threaded handle means 70, somewhat in the form of a wing nut, threaded onto the forward end portion of link 65 and bearing against the front end of guide tube 67 for maintaining the regulator damper means 60 in the desired adjusted position and thereby adjustably restricting the flow of the products of combustion from the combustion chamber 31 through the main opening 60*a* and the smoke passage 63 to the chimney.

The auxiliary damper means 61 also is shown in the form of a substantially rectangular plate and normally occupies a substantially horizontal closed position within the auxiliary opening 61*a*. Opening 61*a* is located in the lower wall of the duct 63*a* rearwardly of the regulator damper means 60. In other words, the auxiliary damper means 61 and the auxiliary opening 61*a* are located rearwardly of the regulator damper means 60 and are therefore positioned more closely adjacent the rear portion of the smoke passage 63 than the regulator damper means 60 and the main opening 60*a*. By the same token, it is apparent that the auxiliary opening 61*a* is located substantially further away from the access doors 51, 51*a* than the main opening 61*a* and positioned more closely adjacent the rear portion of the smoke passage communicating with the chimney.

As shown, and as is preferred, the auxiliary damper means 61 and the auxiliary opening 61*a* are located above the rear portion of the combustion chamber 31 so that, when the door 51 is opened, as will be later described, the damper means 61, then being opened, causes the smoke to be redirected upwardly and outwardly through the auxiliary opening and through the smoke passage 63 to the chimney. Thus, when the auxiliary damper means 61 is opened, the smoke bypasses the main opening 60*a* and thus is redirected further away from the access doors 51, 51*a* so as to prevent the escapement of smoke through the access opening 50 when the access doors 51, 51*a* are opened.

Figure 3:
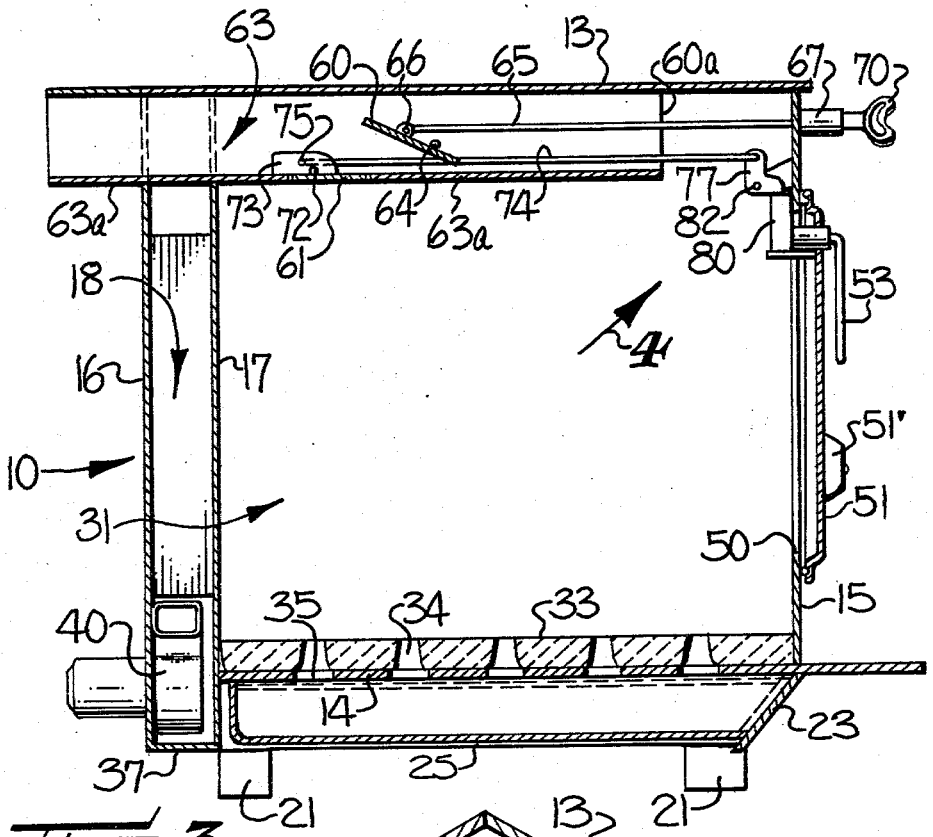
FIG. 3 is a vertical sectional view through the stove taken substantially along line 3—3 in FIG. 1.
Figure 6:
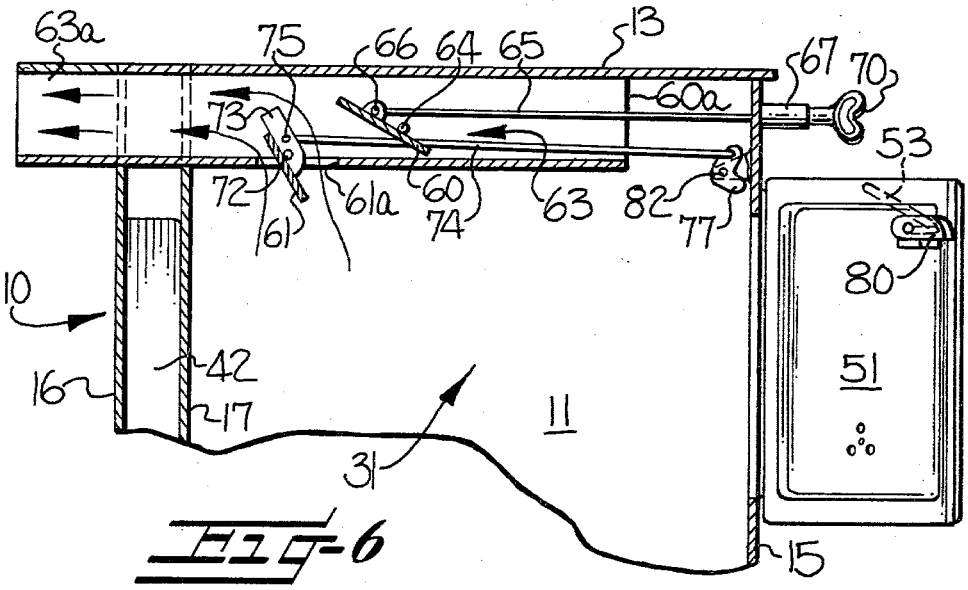
FIG. 6 is a view similar to the upper portion of FIG. 3, but showing the access door and the auxiliary damper means in opened positions.

As best shown in FIGS. 3 and 6, the auxiliary damper means 61 is pivotally mounted, as at 72, on the opposite side wall portions of the duct 63*a*, with the major portion of the weight of the auxiliary damper means 61 being located forwardly of the pivotal axis 72 thereof, thus tending to move and thereby bias the auxiliary damper means 61 toward the open position by gravity. However, during operation of the stove, the auxiliary damper means 61 normally closes the auxiliary opening 61*a*, with means being operably associated with the auxiliary damper means 61 and the access door 51 for effecting movement of the auxiliary damper means. According to the invention, the means operably associated with the auxiliary damper means and the access door for effecting such movement is embodied in a normally active latch means which normally maintains the access door in closed position and is movable to an inactive position for permitting opening of the access door, with means cooperating with the latch means for effecting movement of the auxiliary damper means from the closed position to the opened position upon movement of the latch means from the active position to the inactive position.

Accordingly, the auxiliary damper means 61 is provided with an upwardly extending portion or arm 73 thereon, to a medial portion of which the rear end of a link means 74 is pivotally connected, as at 75. As preferred, the pivotal axis 75 of the link means 74 is located above and rearwardly of the pivotal axis 72 of the auxiliary damper means 61 so that, upon forward movement of link means 74, the auxiliary damper means 61 is tilted from the normally closed position of FIGS. 1 and 3 to the opened position of FIG. 6.

Conversely, upon rearward movement of link means 74, the auxiliary damper means 61 is pivoted to the closed position of FIG. 3. To aid in properly locating the auxiliary damper means 61 in its normally closed position, it is preferred that the arm 73 projects rearwardly beyond the rear edge of auxiliary damper means 61 so that arm 73 may engage the upper surface of the bottom wall of duct 63*a* for stabilizing auxiliary damper means 61 when it occupies its normally closed position as shown in FIG. 3.

The rear portion of link means 74 is disposed within the smoke passage 63. Therefore, link means 74 extends forwardly from the auxiliary damper means 61 and loosely penetrates a suitable slot 76 (FIG. 5) provided in the lower portion of the regulator damper means 60. The forward end of link means 74 is pivotally connected to one arm of a movable element or bell crank 77 (FIGS. 1, 3, 4 and 6) which is movably mounted in the combustion chamber 31 adjacent the access opening 50 and is normally maintained in such a position as to maintain the auxiliary damper means 61 in the normally closed position by means of a normally active actuating means or member 80 which also serves as a latch means or latch member for normally maintaining the door 51 in the normally closed position. The latch member or actuating member 80 is shown in the form of a cam block in FIGS. 1, 4, and 6 which, in addition to having a cam surface thereof normally engaging the movable element 77 for maintaining the auxiliary damper means 61 in the normally closed position, also engages the inner surface of the housing front wall 15 adjacent the opening 50 so as to maintain the door 51 in the closed position.

It will be noted that the movable element 77 is shown in the form of a bell crank pivotally mounted, as at 82, to the front wall 15 of housing 10, and the actuating member or latch member 80 is mounted on the inner end portion of the handle 53, such handle being readily accessible to an operator exteriorly of the stove. The handle 53 may be of substantially L-shaped configuration and pivotally mounted in the access door 51 by extending through the access door 51. Thus, it is apparent that the handle 53 serves as manually operable control means for moving the latch member or actuating member 80 from the active position of FIGS. 3 and 4 to the inactive position of FIG. 6, for releasing the door 51, so the door then may be swung open as in FIG. 6.

Figure 4:
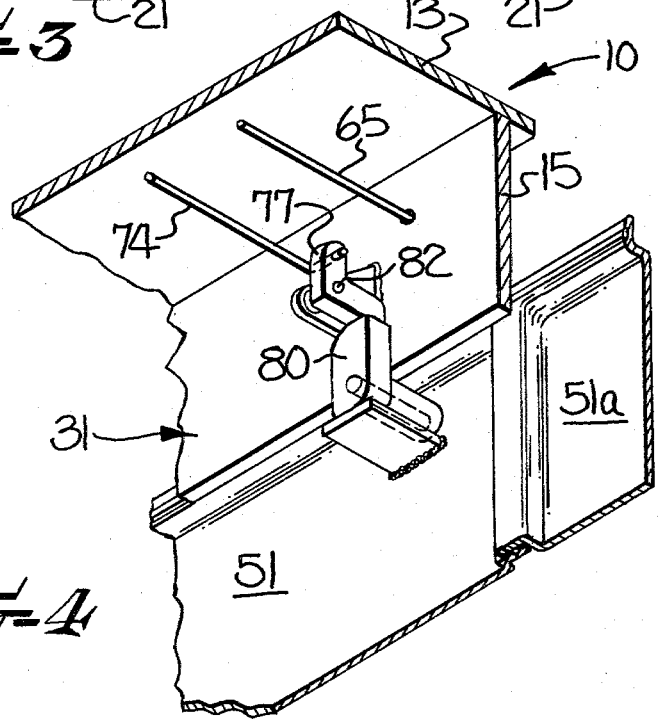
FIG. 4 is an enlarged fragmentary detail of a preferred embodiment of mechanism for effecting movement of the auxiliary damper means of FIGS. 1 and 3 from the normally closed position to the opened position prior to the access doors being opened and being taken looking generally in the direction of the arrow indicated at 4 in FIG. 3.

As the latch member or actuating member 80 is moved to the inactive position from the active position of FIG. 3, it is apparent that the high point or portion of the latch member or actuating member 80 is moved out of engagement with the movable element or bell crank 77, thus permitting the same to move in a clockwise direction in FIGS. 3 and 4 under the weight of the forward portion of the auxiliary damper means 61, and effecting movement of the auxiliary damper means 61 from the normally closed position to the opened position prior to the access door being opened, for thereby redirecting the products of combustion from the combustion chamber 31 through the auxiliary opening 61*a* and thus further away from the access doors 51, 51*a* so as to prevent the escapement of smoke through the access opening 50 as the access door 51 is opened.

It is thus seen that the present invention provides for the controlled regulation of the rate of flow of air and products of combustion from the combustion chamber 31 of the stove during normal use thereof, and the invention also provides for effectively redirecting the products of combustion upwardly from the combustion chamber and further away from the access doors 51, 51*a* of the stove so as to prevent the escapement of smoke through the access opening 50 when the access doors 51, 51*a* are opened.

In the drawings and specification, there has been set forth a preferred embodiment of the invention and although specific terms are employed, they are used in a generic and descriptive sense and not for purposes of limitation.

That which is claimed is:

1. In a stove having a combustion chamber including a lower zone for burning combustibles therein, an access opening for inserting combustibles therethrough into the combustion chamber, and at least one access door for normally closing the access opening, the combination therewith of means defining a smoke passage extending along an upper portion of the stove above the zone for burning combustibles in the combustion chamber and having a rear portion adapted to communicate with a chimney for exhausting the products of combustion from the combustion chamber, said smoke passage having a main opening and an auxiliary opening therein for communication with the interior of the combustion chamber, regulator damper means associated with said smoke passage for normally adjustably restricting the flow of the products of combustion from the combustion chamber through said main opening and said smoke passage to the chimney, auxiliary damper means normally closing said auxiliary opening, said main opening being located adjacent the stove access door so that heated air and products of combustion normally flow in a generally sinuous path toward the access door and then upwardly and away from the access door and into said main opening, said auxiliary opening being located substantially further away from the access door and more closely adjacent the rear portion of the smoke passage than said main opening, and means operably associated with said auxiliary damper means and the stove access door for effecting movement of said auxiliary damper means from the normally closed position to the opened position prior to the access door being opened for redirecting the products of combustion through said auxiliary opening and thus further away from the access door so as to thereby prevent the escapement of smoke through the access opening when the access door is opened.

2. A stove according to claim 1 wherein said means operably associated with said auxiliary damper means and the access door for effecting movement of said auxiliary damper means comprises normally active latch means for normally maintaining the access door in the closed position and being movable to an inactive position for permitting opening of the access door, and means cooperating with said latch means for effecting movement of said auxiliary damper means from the closed position to the opened position upon movement of said latch means from said active position to said inactive position.

3. A stove according to claim 1 or 2 including manually operable control means positioned exteriorly of the stove and operably connected to said regulator damper means for adjusting the same relative to said smoke passage for varying the rate of flow of air and products of combustion from the combustion chamber through said main opening and said smoke passage to the chimney.

4. A stove according to claim 2 including a front wall defining the access opening therein and on which the access door is hingedly supported, and wherein said latch means comprises a latch member carried by the access door and movable between an active position relative to said wall for maintaining the access door in its normally closed position and an inactive position releasing the access door relative to said wall, and further wherein said means cooperating with said latch means comprises a movable element movably mounted in the combustion chamber adjacent the access opening, link means interconnecting said auxiliary damper means and said movable element, said auxiliary damper means being biased toward its opened position, and means movable with said latch member for normally engaging and opposing movement of said movable element under the bias of said auxiliary damper means for maintaining the same in its normally closed position when said latch member occupies its said active position, and handle means accessible to an operator exteriorly of the stove for moving said latch member to its said inactive position to release said movable element for effecting movement of said auxiliary damper means from its normally closed position to its opened position.

5. A stove according to claim 1 wherein said auxiliary damper means is pivotally mounted in said auxiliary opening in such manner that said auxiliary damper means is biased by gravity toward its said opened position, actuating means normally maintaining said auxiliary damper means in its said normally closed position and said means operably associated with said auxiliary damper means and the stove access door for effecting movement of said auxiliary damper means including manually operable control means positioned exteriorly of the stove for moving said actuating means relative to said passage defining means for releasing said auxiliary damper means and permitting the same to gravitate to its open position.

6. A stove according to claim 5 including a front wall defining the access opening therein and on which the access door is hingedly supported, and wherein said means operably associated with said auxiliary damper means and the stove access door for effecting movement of said auxiliary damper means further comprises a movable element mounted on said front wall within the combustion chamber, and link means interconnecting said movable element and said auxiliary damper means, and said actuating means comprising a latch member movably mounted on the access door and normally engaging the inner surface of said front wall and also normally engaging said movable element for maintaining both the access door and said auxiliary damper means in their respective normally closed positions, and said control means comprising handle means movably positioned exteriorly of the access door and connected to said latch member so that said handle means can be manually moved to disengage said latch member from said front wall while releasing said movable element, to in turn, release said auxiliary damper means for permitting the same to gravitate to its open position prior to the access door being opened.

7. A stove according to claim 1 or 5 wherein the combustion chamber includes opposite side walls and top, bottom, front and rear walls, and said front wall has said access opening therein, and wherein said passage defining means comprises an elongate duct extending forwardly and rearwardly along said top wall and within the combustion chamber, said duct having an open front end spaced rearwardly from said front wall and defining said main opening, said regulator damper means being located within said duct between said open front end and said auxiliary opening thereof, and control means positioned exteriorly of said stove for adjusting said regulator damper means relative to said duct for varying the rate of flow of air and the products of combustion through said duct.

8. A stove according to claim 1 including opposite side walls, top, bottom and front walls and an inner rear wall defining the combustion chamber, an outer rear wall spaced from said inner rear wall and defining therewith an enclosed generally vertically extending air heating chamber having at least one air inlet opening in its lower portion, means defining a pair of generally horizontal airflow channels within the combustion chamber communicating with and extending forwardly from said heating chamber along the junctures of said top wall with the respective opposite side walls, said front wall having a pair of air outlet openings located in opposite upper corner portions thereof for exhausting heated air from said heating chamber and said airflow channels therethrough, and fan means for inducing air to flow into and through said heating chamber to be exhausted therefrom through said channels and said outlet openings.

9. A stove according to claim 8 wherein said opposite side walls also are provided with respective air outlet openings in the upper forward corner portions thereof communicating with the respective airflow channels to aid in directing the heated air sideways as well as forwardly from the stove.

10. In a stove having top, bottom, front, rear and opposite side walls defining a combustion chamber including a lower zone for burning combustibles therein, said front wall having an access opening therein for inserting combustibles therethrough into the combustion chamber, and at least one access door for normally closing the access opening, the combination therewith of means defining an elongate smoke passage extending forwardly and rearwardly within an upper portion of the combustion chamber and above the zone for burning combustibles in the combustion chamber, said smoke passage having a rear portion adapted to communicate with a chimney for exhausting the products of combustion from the combustion chamber and also having a main opening and an auxiliary opening therein for communication with the interior of the combustion chamber, regulator damper means associated with said smoke passage for normally restricting the flow of the products of combustion from the combustion chamber through said main opening and said smoke passage to the chimney, handle means positioned exteriorly of the stove and operably connected to said regulator damper means for adjusting the same relative to said smoke passage for varying the rate of flow of products of combustion through said main opening and said smoke passage to the chimney, said main opening being located adjacent the stove access door so that heated air and products of combustion normally flow in a generally sinuous path toward the access door and then upwardly and away from the access door and into said main opening, auxiliary damper means normally closing said auxiliary opening, said auxiliary opening being located rearwardly of said regulator damper means and thus further away from the access door and more closely adjacent the rear portion of said smoke passage than said main opening, access door handle means carried by and positioned exteriorly of said access door for opening and closing the same, and means operably associated with said auxiliary damper means and said access door handle means for effecting movement of said auxiliary damper means from the normally closed position to the opened position prior to the access door being opened for redirecting the products of combustion through said auxiliary opening and thus further away from the access door so as to thereby prevent the escapement of smoke through the access opening when the access door is opened.

11. A stove according to claim 10 wherein both said regulator damper means and said auxiliary damper means are mounted so as to be biased toward their respective opened positions, means operably associated with said first-named handle means for normally restraining the respective regulator damper means against movement to its fully opened position, and said means operably associated with said auxiliary damper means and said access door handle means including means normally restraining said auxiliary damper means from movement to its open position when the access door is in its normally closed position.

12. A stove according to claim 10 wherein said auxiliary damper means is pivotally mounted in said smoke passage in such manner that said auxiliary damper means is biased by gravity toward its said opened position, and wherein said means operably associated with said auxiliary damper means and said access door handle means for effecting movement of said auxiliary damper means comprises a movable element mounted on said front wall within the combustion chamber, link means interconnecting said movable element and said auxiliary damper means, a latch member movably mounted on the access door and connected to said access door handle means, said latch member normally being in engagement with the inner surface of said front wall and also normally being in engagement with said movable element for maintaining both the access door and said auxiliary damper means in their respective normally closed positions, and said access door handle means being adapted to be manually moved to disengage said latch member from said front wall while releasing said movable element, to in turn, release said auxiliary damper means for permitting the same to gravitate to its open position prior to the access door being opened.

13. A stove according to claim 10 wherein said smoke passage defining means comprises an elongate, substantially channel-shaped duct, and wherein the stove top wall serves as the top wall of said duct so that heated air flowing with the products of combustion from the combustion chamber will aid in heating the stove top wall as such heated air flows through said smoke passage.

14. A stove according to any one of claims 10 to 13 wherein said elongate smoke passage is located substantially midway between said opposite side walls of the stove, said stove rear wall defining a closed substantially vertical air heating chamber in back of and in heat exchanging relation to the combustion chamber, a pair of elongate outlet airflow channels extending in generally parallel relation to and spaced from said smoke passage, said airflow channels being positioned to extend along the junctures of the above opposite side walls with the stove top wall and within the combustion chamber, said stove front wall having a pair of air outlet openings in opposite upper corners thereof for discharge of heated air therethrough from the respective airflow channels, the rear portions of said airflow channels being in communication with the upper portion of said air heating chamber, and fan means for circulating air through said air heating chamber and exhausting the air through said channels and said outlet openings.

* * * * *

UNITED STATES PATENT AND TRADEMARK OFFICE

CERTIFICATE OF CORRECTION

PATENT NO. : 4,280,476

DATED : July 28, 1981

INVENTOR(S) : James E. Webb

It is certified that error appears in the above-identified patent and that said Letters Patent are hereby corrected as shown below:

Column 1, line 41, "operable" should be --operably--.

Column 14, Clain 14, line 12, "above" should be --stove".

Signed and Sealed this

*Twenty-seventh* Day of *October 1981*

[SEAL]

*Attest:*

GERALD J. MOSSINGHOFF

*Attesting Officer*

*Commissioner of Patents and Trademarks*